United States Patent [19]

Cummings et al.

[11] Patent Number: 4,715,128

[45] Date of Patent: Dec. 29, 1987

[54] CURVATURE PROBE AND METHOD

[75] Inventors: Richard E. Cummings, Camino; Charles S. Mackey, Bakersfield, both of Calif.; Robert W. Dickinson, 40 Maplewood Dr., San Rafael, Calif. 94901; Ben W. O. Dickinson, III, 2125 Broderick St., San Francisco, Calif. 94115; Merle D. Larsen, Concord, Calif.

[73] Assignees: Ben Wade Oakes Dickinson III; Robert Wayne Dickinson, both of San Francisco, Calif.

[21] Appl. No.: 811,531

[22] Filed: Dec. 19, 1985

[51] Int. Cl.[4] ..... G01B 7/28

[52] U.S. Cl. ..... 33/544; 33/178 F; 33/534; 33/1 H

[58] Field of Search ..... 33/511, 512, 534, 544, 33/1 N, 1 H, 1 PT, 175, 177, 312, 313, 304, 178 R, 178 E, 178 F

[56] References Cited

U.S. PATENT DOCUMENTS

| | | | |
|---|---|---|---|
| 3,821,856 | 7/1974 | Rapp | 33/544 X |
| 3,991,745 | 11/1976 | Yoslow et al. | 33/512 X |
| 4,570,354 | 2/1986 | Hindes | 33/534 |

*Primary Examiner*—Harry N. Haroian

*Attorney, Agent, or Firm*—Flehr, Hohbach, Test, Albritton & Herbert

[57] ABSTRACT

Probe and method for determining the curvature of an elongated opening such as a borehole in the earth. The probe includes an axially extending flexible shaft and two pairs of sensing wires arranged in quadrature about the shaft for axial movement relative to each other upon bending of the probe. The relative axial positions of the sensing wires on opposite sides of the flexible shaft are monitored to determine the curvature of the borehole.

16 Claims, 3 Drawing Figures

CURVATURE PROBE AND METHOD

This invention relates generally to downhole instrumentation, and more particularly to a probe and method for determining the curvature of a borehole or other extended opening.

In the drilling of oil wells and other boreholes in the earth, it is frequently necessary to determine the location of the drill or the precise location of the hole at a substantial distance below the surface of the earth. For this purpose, a surveying probe is inserted into the hole, and data from the probe is analyzed at the surface to determine the location and orientation of the probe.

One prior art device for measuring the curvature of a borehole in oil well logging operations has two sensing wires positioned 90° apart about the centerline of an axially extending probe for measuring the difference between the centerline length and two orthogonal side lengths to determine the curvature to which the probe is bent when it is positioned in the hole. This device has certain limitations and disadvantages in that changes in temperature, pressure, tensive or compressive forces to which the probe is subjected can cause the centerline length to change, giving false curvature readings.

It is in general an object of the invention to provide a new and improved curvature probe and method.

Another object of the invention is to provide a curvature probe and method of the above character which overcome the limitations and disadvantages of curvature probes heretofore provided.

These and other objects are achieved in accordance with the invention by providing a curvature probe with an axially extending flexible shaft, a plurality of axially spaced guide members mounted on the flexible shaft, and two pairs of axially extending sensing wires positioned in quadrature about the shaft with the two wires in each pair being positioned on opposite sides of the shaft. The sensing wires pass freely through axially aligned openings in the guide members and are free to move relatively to each other in an axial direction upon bending of the probe. The relative axial positions of the two wires in each pair are monitored to provide an output signal corresponding to the curvature to which the probe is bent.

Figure 1:
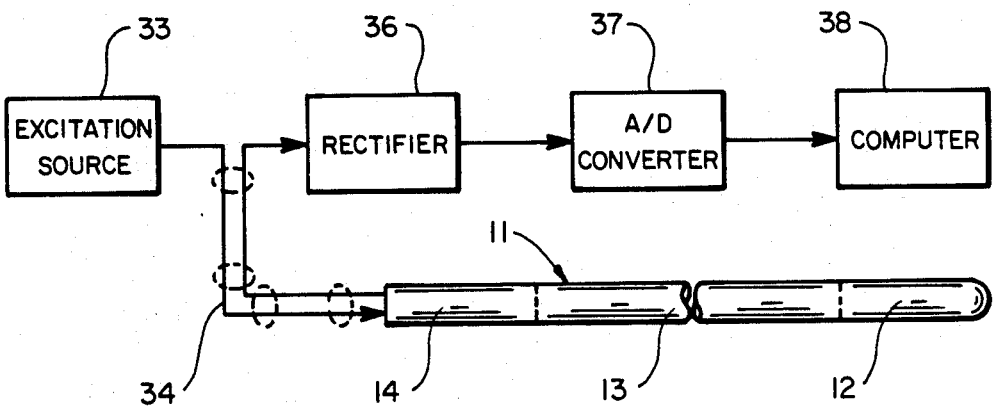
FIG. 1 is a schematic diagram of one embodiment of a curvature probe system incorporating the invention.

As illustrated in FIG. 1, the curvature probe has an elongated body 11 of generally circular cross-section. A roll sensor 12 is mounted in the forward section of the body, a curvature sensor 13 is mounted in the central section, and electronic circuitry 14 for processing signals from the roll sensor and the curvature sensor is mounted in the rear section of the body. The roll sensor is of suitable known design, and it provides an output signal corresponding to the orientation of the probe about its longitudinal axis. In one presently preferred embodiment, the roll sensor utilizes a gravitational reference, and the output signal from this device indicates the orientation of the probe relative to the downward direction, i.e. toward the center of the earth.

The length of the probe is substantially longer than the diameter, and the outer diameter of the probe is slightly less than the diameter of the hole to be logged.

In one embodiment, the probe has a diameter on the order ¾ of an inch, and the central section in which the curvature sensor is located has a length on the order of 18 inches.

Figure 2:
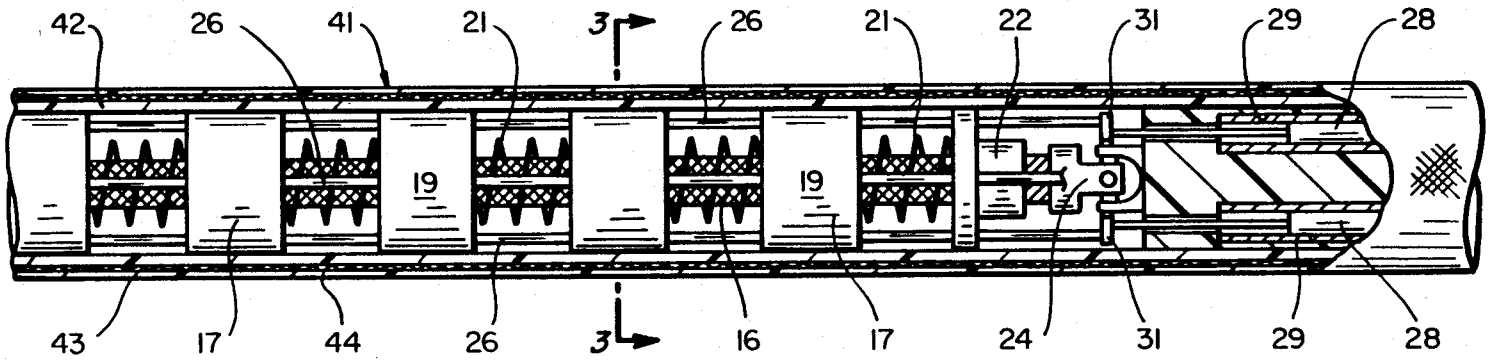
FIG. 2 is a fragmentary sectional view of the curvature probe in the embodiment of FIG. 1.

As illustrated in FIG. 2, the curvature sensor has an axially extending flexible shaft 16 positioned centrally within the probe body. The flexible shaft is freely bendable about its axis, but it is torsionally rigid, i.e. it does not twist about its axis when rotated. In one presently preferred embodiment, the shaft comprises a double-woven cable which is substantially neutral and has no bias which favors or resists flexing in a particular direction. This type of cable is commonly employed for control drives.

A plurality of guide members or spacers 17 are mounted on shaft 16. Each of the members comprises a generally annular body having a central opening 18 through which the flexible shaft extends. In most of the guide members, openings 18 are of slightly larger diameter than shaft 16 so that the guide members are free to move in the axial direction on the shaft. Each of the guide members has an outer peripheral surface 19 with a contour corresponding to the cross-sectional contour of the opening in which the probe is used. The guide members are preferably fabricated of a rigid material such as nylon, but they can be fabricated of any suitable material.

Means is provided for maintaining the guide members at an axially spaced relationship on the flexible shaft. This means includes compression springs 21 which are positioned coaxially about the shaft and bear against the confronting faces of the guide members. The guide members and springs are retained on the shaft by hubs 22 which are affixed to the shaft by suitable means such as set screws (not shown) near the ends of the shaft. In addition, every sixth one of the guide members is affixed to the shaft in a similar manner. The hubs and the stationary guide members are positioned to hold the springs in a partially compressed condition which maintains the spacing of the guide members and does not significantly impair the ability of the probe to flex or bend.

The end portions of the flexible shaft are connected to end pieces 23 by universal joints 24. The end pieces are generally cylindrical bodies of the same diameter as guide members 17, and they are axially aligned with the guide members.

Sensing wires 26 extend longitudinally of the probe in parallel spaced relation to flexible shaft. The sensing wires are positioned in quadrature about the shaft and arranged in pairs, with the two wires in each pair being an opposite sides of the shaft. The sensing wires pass through axially aligned openings 27 in guide members 17 and hubs 22 and are affixed at one end to end pieces 23. The free ends of the sensing wires are connected to transducers 28 which provide electrical output signals corresponding to the positions of the free ends. The movement of the free ends, and hence the sensitivity of the probe, is dependent upon the distance of the wires from the center line of the probe, increasing as the wires are positioned farther from the center. The transducers are mounted in bores 29 in end pieces 23, with the transducers for the two pairs of wires being positioned at opposite ends of the wires. The axes of the wires and the transducers are offset from each other, and the wires are connected to the transducers by radially extending connector plates 31. Being affixed to shaft 16, the transducer bodies move relative to the sensing wires, providing greater sensitivity on a differential basis.

In the presently preferred embodiment, the position sensing transducers are linear voltage differential transformers (LVDTs) such as the Schaevitz XS-B series of sub-miniature LVDTs. These devices produce output signals corresponding to the displacement of magnetic cores to which the sensing wires are connected. Each transformer has a primary coil flanked by two secondary coils on a cylindrical form, with the core moving axially within the coils and providing a path for magnetic flux linking the coils. When the primary coil is energized with an alternating current, voltages are induced in the two secondary coils. These coils are connected in series opposition, and the net output of the transformer is the difference between the voltages induced in the two coils, which is zero when the core is at the center or null position. When the core is moved from the null position, the induced voltage in the coil toward which the core is moved increases, while the induced voltage in the opposite coil decreases. This produces a differential voltage output that varies linearly as the core moves from one end of its travel to the other. The two output signals from the transformers associated with the wires in each pair are summed together to provide a single output signal for the pair.

Referring again to FIG. 1, an excitation signal for the LVDTs is provided by a source 33 located at the surface of the earth and connected to the probe by a cable 34. In one presently preferred embodiment, the excitation signal is an AC voltage on the order of 20 volts RMS and a frequency of 2 kHz. Source 33 also provides operating power (±10 VDC) for the probe. After processing by circuitry 14, the output signals from the LVDTs are transmitted to the surface of the earth by cable 34 and converted to DC signals by a rectifier 36. The DC signals are converted to digital signals by an analog-to-digital converter 37 and applied to a computer 38 which determines the curvature of the probe from these signals. The computer also processes information provided by roll sensor 12 to determine the orientation or direction of the curvature.

Figure 3:
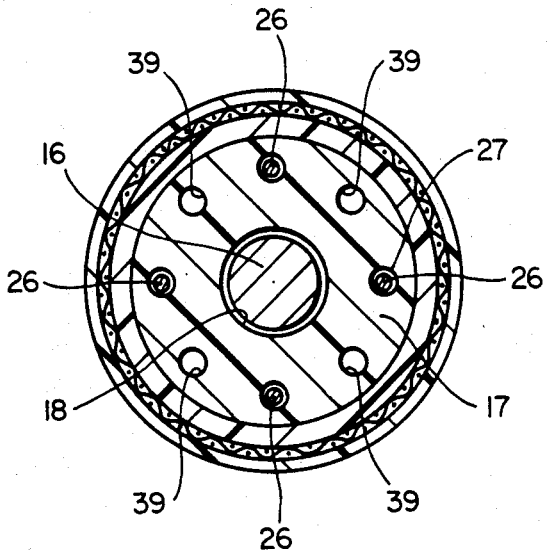
FIG. 3 is a cross-sectional view taken along line 3—3 in FIG. 2.

For clarity and ease of illustration, the transducer and roll sensor wiring has been omitted from FIGS. 2 and 3. However, the wires for the roll sensor and the transducers at the forward or distal end of the probe extend in an axial direction through openings 39 in guide members 17 and pass through suitable openings in the end pieces.

The central section of the probe is enclosed within a flexible casing 41 which comprises a flexible tubing 42 surrounded by a layer of fabric 43 which has a high tensile strength, and a layer of crushable material 44. The tubing is fabricated of a flexible material such as a suitable plastic, and in one presently preferred embodiment, it comprises a Hytrel tubing having a wall thickness on the order of 0.035 inch. The fabric layer 43 comprises a fabric woven or braided of fibers having a high tensile strength, e.g. 250,000 lb/in$^2$, and one presently preferred fabric is an aromatic polyamide fiber manufactured by DuPont under the trademark Kevlar. Outer layer 44 permits the probe to be crushed or deformed slightly to accommodate small irregularities and help to keep the probe centered within the hole in which it is used. In one presently preferred embodiment, the crushable material is a material having a pile of the type employed in Velcro fasteners. This material provides a crush on the order of 0.030 inch.

Roll sensor 12 and electronic circuitry 14 are packaged in the manner described in U.S. Pat. No. 4,524,324. This package includes a flexible body comprising a mass of cushioning material in which the sensors and electronic components are embedded, with a flexible outer casing of fabric having a high tensile strength.

The interior of the probe is sealed and filled with a fluid such as silicone oil to provide insulation and to maintain a pressure balance inside and outside the probe. When the probe is driven hydraulically through an oil well casing or another borehole in the earth, it is subjected to pressures on the order of 3,000–5,000 PSI.

If desired, the effective diameter of the probe can be increased for use in larger holes by mounting extension rings (not shown) over the guide members outside probe casing. A compressive material (not shown) is placed between the rings to prevent buckling, and a crushable material (not shown) is placed on the outer surfaces of the rings.

Operation and use of the curvature probe, and therein the method of the invention, are as follows. The probe is inserted into the borehole or other opening where curvature is to be measured and propelled through the hole by suitable means such as pressurized fluid. As the probe travels through the hole, it flexes or bends in accordance with the curvature of the hole. As the probe bends, the free ends of the sensing wires on opposite sides of the probe move in opposite directions by amounts depending upon the radius of curvature. The positions of the free ends are monitored by the LVDTs, and the signals produced by the LVDTs are combined and processed to determine the curvature of the opening.

The probe has been found to have an accuracy on the order of ±1% in pitch (inclination or profile) and ±2% in yaw (plan or azimuth). This accuracy compares favorably with the results obtained with relatively expensive optical instruments and makes the probe suitable for use in applications requiring a high degree of accuracy.

It is apparent from the foregoing that a new and improved curvature probe and method have been provided. While only certain presently preferred embodiments have been described in detail, as will be apparent to those familiar with the art, certain changes and modifications can be made without departing from the scope of the invention as defined by the following claims.

We claim:

1. In a curvature probe: an axially extending flexible shaft, a plurality of axially spaced guide members mounted on the flexible shaft and being movable axially of the shaft, means between adjacent ones of the guide members for maintaining the guide members in a spaced relationship, two pairs of axially extending sensing wires positioned in quadrature about the shaft with the two wires in each pair being positioned on opposite sides of the shaft, said wires passing freely through axially aligned openings in the guide members and being free to move relative to each other in an axial direction upon bending of the probe, and means responsive to the relative axial positions of the two wires in each pair for providing an output signal corresponding to the curvature to which the probe is bent.

2. The curvature probe of claim 1 wherein the means for maintaining the guide members in a spaced relationship includes compression springs which are positioned coaxially of the flexible shaft and bear against the confronting faces of the guide members.

3. The curvature probe of claim 1 wherein the means responsive to the axial positions of the wires includes a transducer connected to one end of each of the wires.

4. The curvature probe of claim 3 wherein the transducers are linear voltage differential transformers.

5. The curvature probe of claim 1 wherein each of the guide members has an outer peripheral surface with a contour corresponding to the cross-sectional contour of an opening into which the probe is inserted.

6. The curvature probe of claim 5 including a flexible casing encasing the flexible shaft, guide members and sensing wires with a crushable material surrounding the guide members to help to keep the guide members centered in the opening notwithstanding variations in the cross-sectional contour of the opening.

7. The curvature probe of claim 6 wherein the crushable material is a Velcro material.

8. In a method of determining the curvature of a borehole with a probe having an axially extending flexible shaft and two pairs of sensing wires arranged in quadrature about the shaft, said wires being held a predetermined radial distance from the flexible shaft by a plurality of guide members mounted on the shaft with the guide members and the wires being free for axial movement relative to each other upon bending of the probe, the steps of: inserting the probe into the borehole so that the probe is bent to a curvature corresponding to the curvature of the borehole, maintaining the guide members in a spaced relationship during bending of the probe, and monitoring the relative axial positions of the sensing wires on opposite sides of the flexible shaft to determine the curvature of the borehole.

9. In a curvature probe: an axially extending flexible shaft, a plurality of axially spaced guide members mounted on the flexible shaft, springs positioned between adjacent ones of the guide members for maintaining axial separation between the guide members, axially extending sensing wires positioned in quadrature about the shaft, said wires passing freely through axially aligned openings in the guide members and being free to move relative to each other in an axial direction upon bending of the probe, and means responsive to the relative axial positions of the wires for providing an output signal corresponding to the curvature to which the probe is bent.

10. The curvature probe of claim 9 including hub members affixed to the shaft for maintaining the compression springs in a partially compressed condition.

11. The curvature probe of claim 9 including means for affixing some of the guide members to the shaft with the remainder of the guide members being free to move on the shaft.

12. The curvature probe of claim 9 wherein the means responsive to the relative axial positions of the wires includes linear voltage differential transformers connected to the ends of the wires.

13. The curvature probe of claim 9 wherein the guide members and the sensing wires are encased in an axially extending flexible tube surrounded by a layer of fabric having a high tensile strength and a layer of crushable material outside the layer of fabric.

14. The curvature probe of claim 13 wherein the fabric comprises an aromatic polyamide fibrous material, and the crushable material comprises a crushable pile.

15. The curvature probe of claim 9 wherein the flexible shaft comprises a torsionally rigid woven cable.

16. The curvature probe of claim 1 wherein the flexible shaft comprises a torsionally rigid woven cable.

* * * * *